United States Patent [19]

Abolins

[11] 3,962,749

[45] June 15, 1976

[54] HINGE BUTT AND MOUNTING ASSEMBLY

[75] Inventor: Andrew Abolins, Langhorne, Pa.

[73] Assignee: Strick Corporation, Fairless Hills, Pa.

[22] Filed: May 22, 1975

[21] Appl. No.: 580,026

[52] U.S. Cl. ..... 16/135; 16/128 R
[51] Int. Cl.[2] ..... E05D 5/06
[58] Field of Search ..... 296/55, 100, 106, 44; 49/381, 383, 385, 389, 390, 36; 16/128 R, 135, 138, 178, 179

[56] References Cited

UNITED STATES PATENTS

| | | | |
|---|---|---|---|
| 1,135,547 | 4/1915 | Pleins | 16/135 |
| 2,141,298 | 12/1938 | Heinz | 296/44 |
| 2,163,323 | 6/1939 | Howe | 296/44 |
| 3,479,683 | 11/1969 | Hull | 16/135 X |
| 3,564,771 | 2/1971 | Reynolds | 49/383 |

*Primary Examiner*—G. V. Larkin
*Attorney, Agent, or Firm*—Connolly and Hutz

[57] ABSTRACT

The butt of an aluminum 270° hinge is inserted and welded into a slot in an elongated aluminum rib forming the rear corner extremities of the cargo container of a highway semi-trailer. A tapered plug extending from the base of the butt is welded into an elongated slot in the rib from the side of the rib remote from the hinge. The hinge pin is disposed closely adjacent to the outer end of the rib. A concave indentation in the base of the butt receives a convex portion of the hinge strap.

10 Claims, 10 Drawing Figures

HINGE BUTT AND MOUNTING ASSEMBLY

BACKGROUND OF THE INVENTION

In attaching hinges to aluminum ribs it is important to maintain the pivot of the hinge as close as possible to the rib, to avoid weakening the rib and to provide a strong durable as possible hinge assembly.

SUMMARY

In accordance with this invention the hinge butt has a tapered plug on its base which is inserted within a slot through the rib. The butt is secured within the slot by a weldment between the tapered plug and the inner wall of the slot accessible through the back of the rib. A particularly strong assembly is formed by a forged aluminum alloy hinge butt attached to an extruded aluminum alloy rib. The base of the butt may be concavely indented to permit a curved strap to nest closely within it.

BRIEF DESCRIPTION OF THE DRAWINGS

Novel features and advantages of the present invention will become apparent to one skilled in the art from a reading of the following description in conjunction with the accompanying drawings wherein similar reference characters refer to similar parts and in which.

DESCRIPTION OF THE PREFERRED EMBODIMENT

Figure 1:
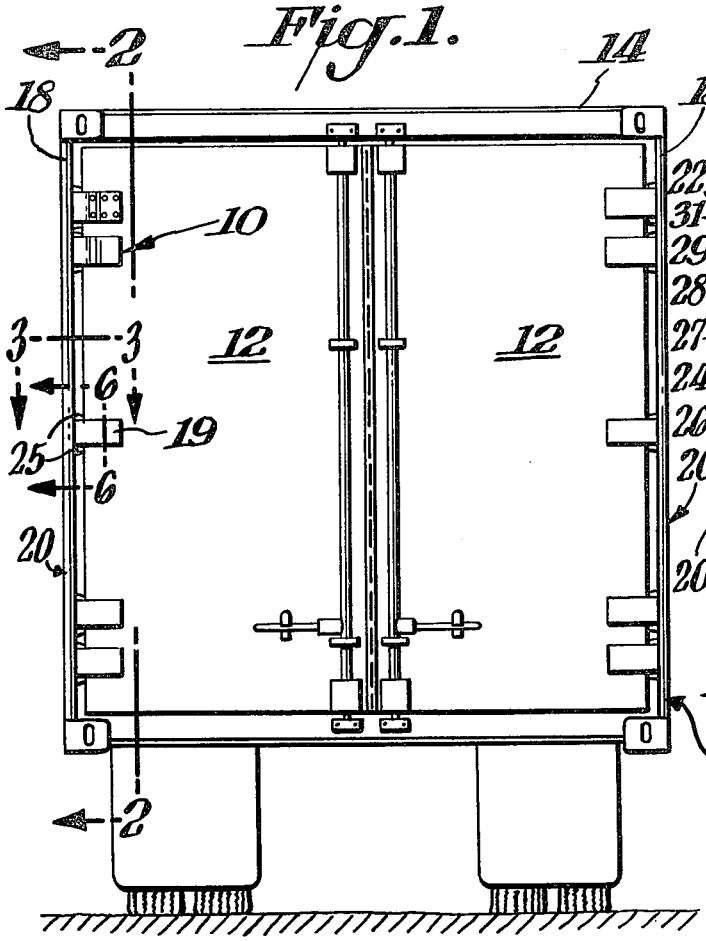
FIG. 1 is a rear view in elevation of ten embodiments of this invention installed on the rear doors of the cargo container of a semi-trailer.
Figure 8:
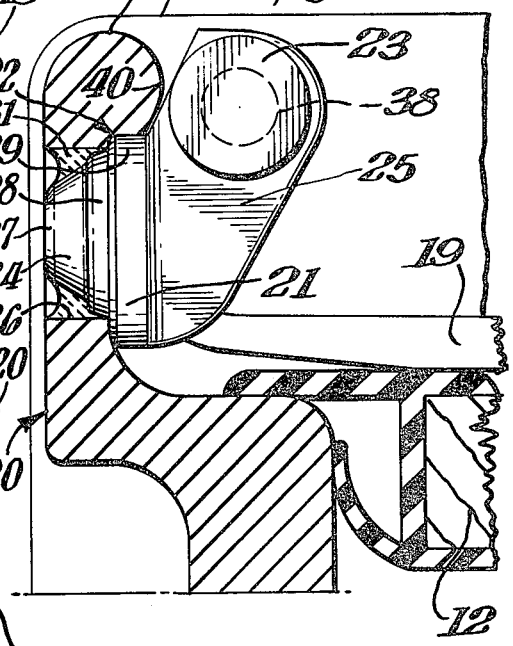
FIG. 8 is a cross-sectional view taken through FIG. 4 along the line 8—8.
Figure 9:
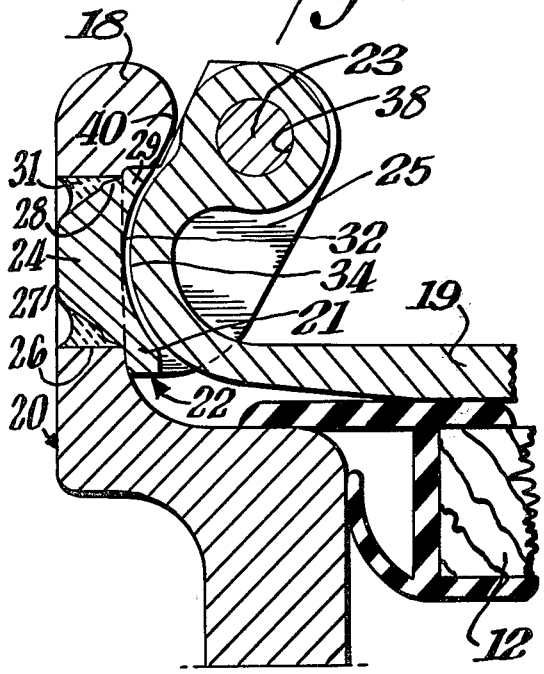
FIG. 9 is a cross-sectional view taken through FIG. 4 along the line 9—9.
Figure 10:
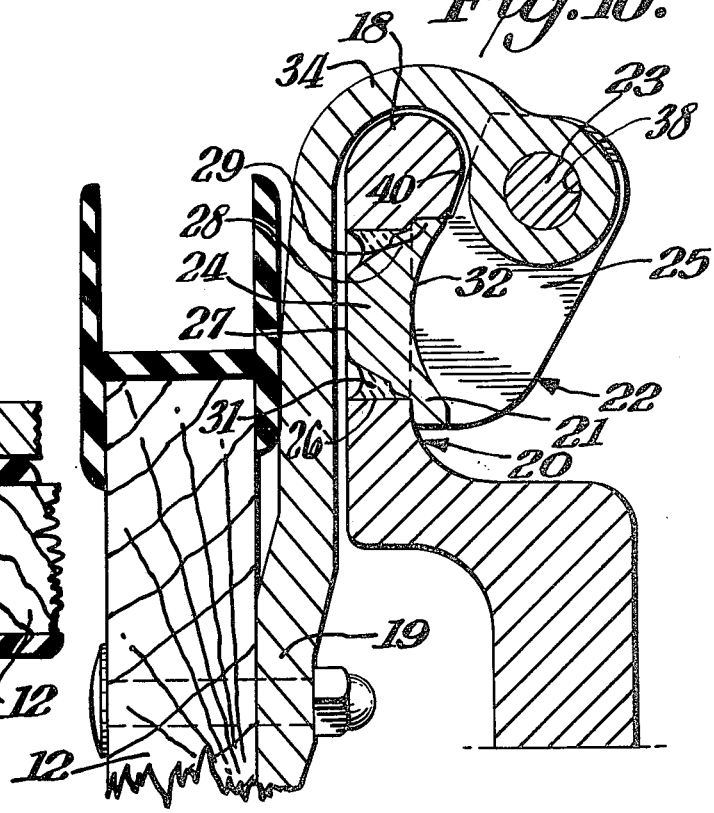
FIG. 10 is a cross-sectional view similar to FIG. 9 with the hinge in the opened position.
Figure 2:
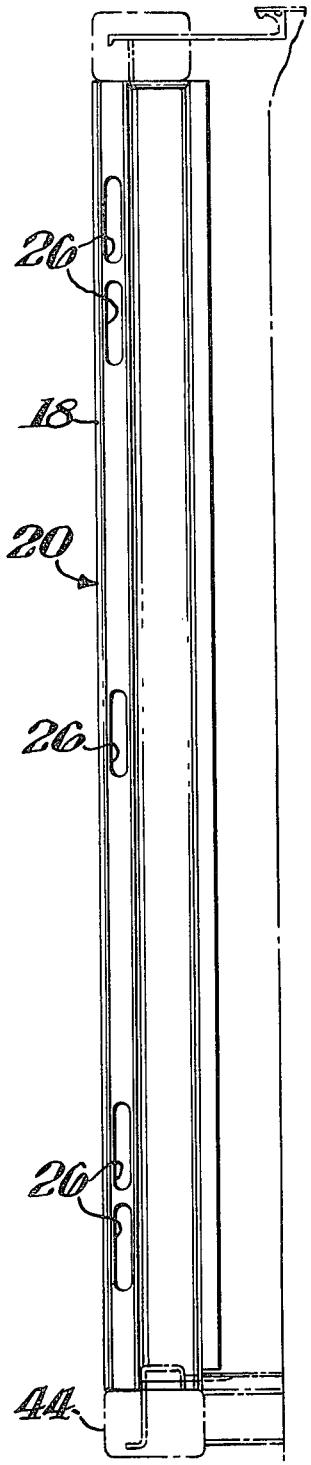
FIG. 2 is a cross-sectional view taken through FIG. 1 along the line 2—2 illustrating slots inside corner extrusions before hinge butt assemblies and door are attached.
Figure 3:
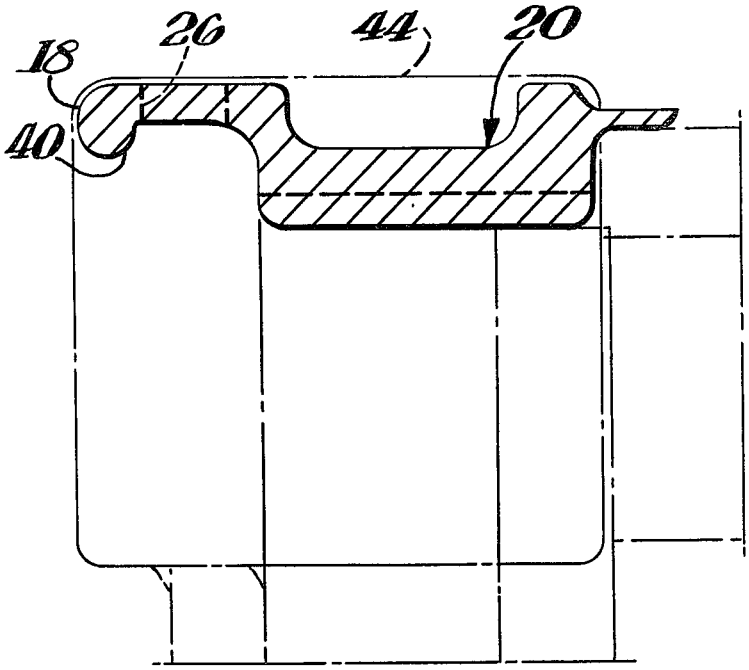
FIG. 3 is a cross-sectional view taken through FIG. 1 along the line 3—3 illustrating a cross-section of corner extrusions before hinge butt assemblies and door are attached.
Figure 5:
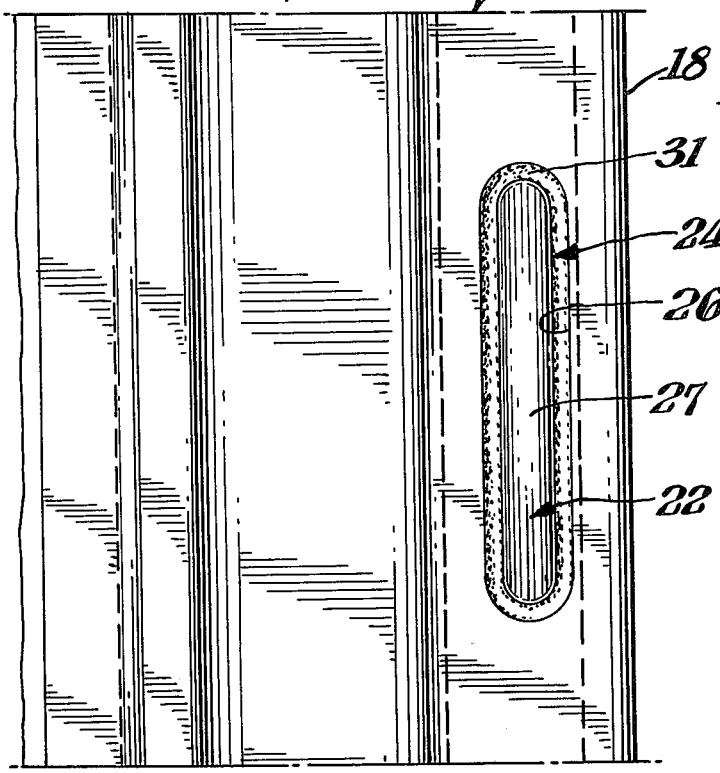
FIG. 5 is a left side view of the hinge shown in FIG. 4.
Figure 4:
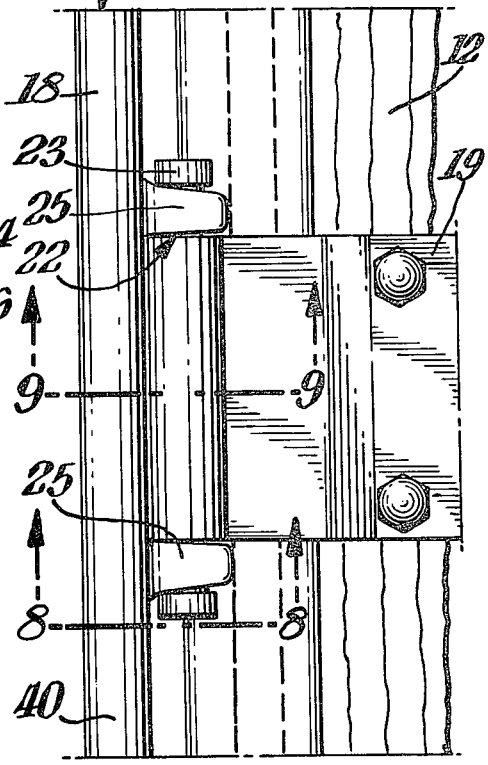
FIG. 4 is an enlarged fragmental rear view of one of the mounted hinges shown in FIG. 1.
Figure 6:
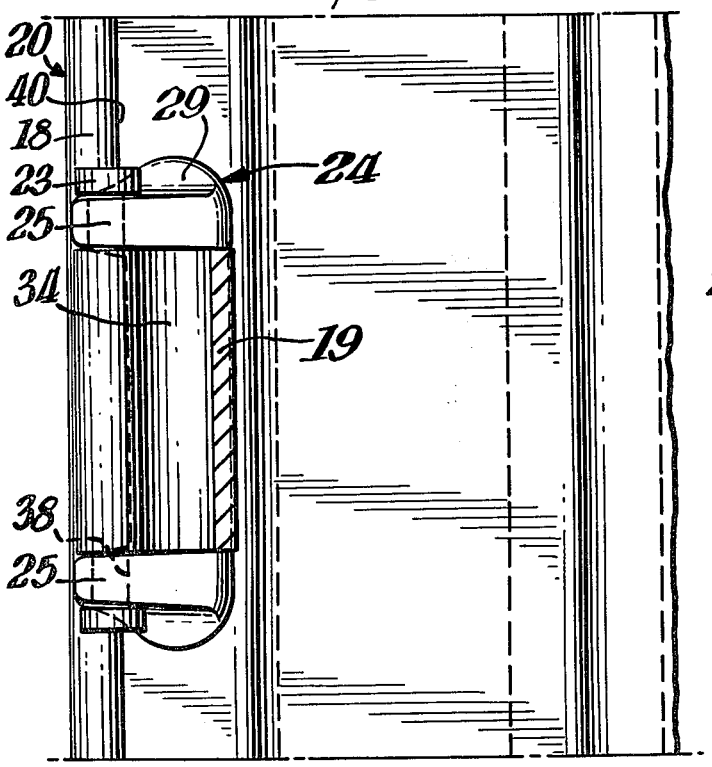
FIG. 6 is a cross-sectional view taken through FIG. 1 along the line 6-6.
Figure 7:
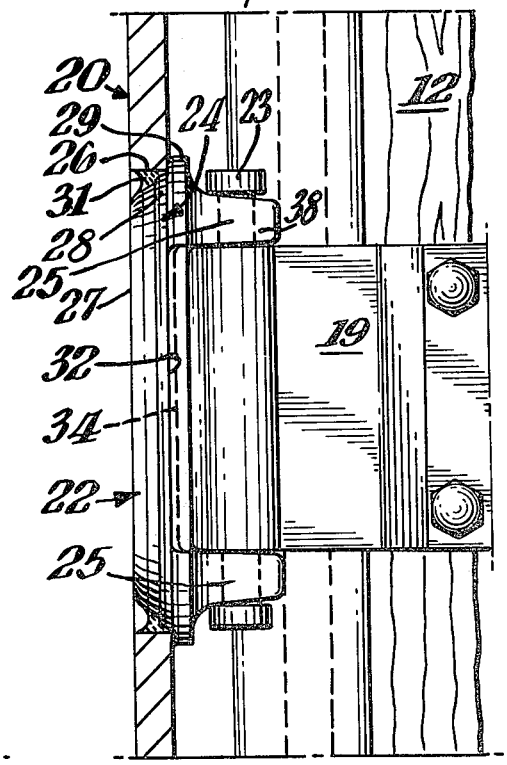
FIG. 7 is a view in elevation similar to FIG. 6 with a portion of the supporting rib in cut away cross-section.

In FIG. 1 are shown ten mounted hinges 10, connecting rear doors 12 of cargo container 14 of semi-trailer 16 to vertical ribs 18 disposed at the rear sides of cargo container 14. Ribs 18, as shown in FIGS. 2–10 are the outer extremities of aluminum extrusions 20 which are the main structural members of the rear sides of container 14.

Hinges 10 each include hinge straps 19 and hinge butts 22 connected to each other by hinge pins 23. Hinge pins 23 are received in ears 25 on the front of base 21 of butt 22. All of the aforementioned parts, particularly butt 22 are made of an aluminum alloy.

A plug 24 on the back of base 21 tapers to a relatively sharper tapered end 27 from an upper slightly tapered root 28 disposed adjacent flange 29 on the front of butt 22.

Tapered plug 24 is inserted within an elongated slot 26 of rib 18 in which it is loosely engaged at root 28.

A length of drill rod is inserted through the holes 38 in the four ears 25 of the upper and lower pair of hinge butts 22 to insure alignment of butts 22 to rear corner extrusion 20. Using 180 amperes, 28 volts, with inert gas flow of 60 CFH (40 He, 20 AR) a MIG weld 31 is deposited in one pass with a 3/64 inch diameter electrode (Alloy 5183). The recommended power supply is a 500 ampere Westinghouse D.C. rectifier with an Airco Midget Mig. Gun.

The front surface 32 of base 21 is concavely indented for receiving the convexly curved end 34 of hinge strap 19 in the closed condition.

Hinge pin 23 is disposed closely adjacent the rounded end 40 of rib 18. This substantially protects pin 23 in both the opened and closed positions of hinges 10 and attached doors 12. In the closed position shown in FIG. 8, all parts of hinge 10 are disposed within the side and rear outline 44 of semi-trailer 16. The cross-sectional shape of rib 18 intimately accommodates hinge 10 in its narrower mid-portion. It also enlarges into rounded end 40 to endow rib 18 and its assembly with hinge 10 with very high strength in all positions of hinge 10.

I claim:

1. A mounted hinge butt for connection to an exposed elongated member having an inside and outside comprising an elongated base having a front and a back, a slot in the member, an elongated tapered plug on the back of the base loosely engaged within the slot with the base on the inside of the member and a weldment between the plug and the inner wall of the slot accessible from the outside of the member whereby the butt is secured to the member.

2. A mounted hinge butt as set forth in claim 1 wherein the butt is tapered to have a relatively smaller end.

3. A mounted hinge butt as set forth in claim 2 wherein the base has a flange at the junction of the plug and the base for engaging the inside of the member.

4. A mounted hinge butt as set forth in claim 3 wherein the tapered plug has a lower section of relatively greater taper and a root section of lesser taper.

5. A mounted hinge butt as set forth in claim 1 wherein a hinge strap is assembled to the hinge butt, the hinge strap having a convex surface, and the base of the butt having a concave indentation for receiving the convex portion of the hinge strap.

6. A mounted hinge butt as set forth in claim 1 wherein the hinge butt and member are each of an aluminum alloy.

7. A mounted hinge butt as set forth in claim 1 wherein the plug is tapered to have a relatively smaller extremity with a lower section of relatively greater taper and a root section of lesser taper.

8. A mounted hinge butt as set forth in claim 7 wherein a hinge strap is assembled to the hinge butt, the hinge strap having a convex surface, and the base of the butt having a concave indentation for receiving the convex portion of the hinge strap.

9. A mounted hinge butt as set forth in claim 8 wherein hinge ears are connected to the front of the elongated base, a hinge pin is inserted through the ears, and the ears being constructed and arranged to dispose the hinge pin closely adjacent the end of the member.

10. A mounted hinge butt as set forth in claim 9 wherein the end of the member is curved and the ears are correspondingly curved to intimately dispose them against the curved end with the hinge pin disposed closely adjacent thereto.

* * * * *